United States Patent [19]

Kutzler

[11] Patent Number: 4,463,315

[45] Date of Patent: Jul. 31, 1984

[54] CD POWER PACK TESTER

[75] Inventor: John M. Kutzler, Waukegan, Ill.

[73] Assignee: Outboard Marine Corporation, Waukegan, Ill.

[21] Appl. No.: 367,569

[22] Filed: Apr. 12, 1982

[51] Int. Cl.[3] ..... F02P 17/00

[52] U.S. Cl. ..... 324/382

[58] Field of Search ..... 324/382, 380, 383

[56] References Cited

FOREIGN PATENT DOCUMENTS 2066968 7/1981 United Kingdom ..... 324/382

*Primary Examiner*—Stanley T. Krawczewicz

*Attorney, Agent, or Firm*—Michael, Best & Friedrich

[57] ABSTRACT

Disclosed herein is a CD power pack tester adapted for connection to an AC line and to a CD power pack, the CD power pack including a rectifier circuit connected to a charge capacitor and an ignition SCR which allows the charge capacitor to discharge through an engine ignition coil to effect firing of an engine spark gap. The tester comprises a power transformer including a primary winding, and a secondary charging winding having an output for simulating the voltage of an engine charge coil to charge the charge capacitor, and a secondary trigger winding for providing a trigger voltage to the ignition SCR, a tester ignition coil, a tester spark gap, and a plurality of switches connected in circuit with the power transformer, the trigger means, and the tester ignition coil, and operative for connecting the primary winding to the AC line and the secondary charging winding to the rectifier circuit to charge the charge capacitor, and for connecting the secondary trigger winding to the ignition SCR so that the ignition SCR is rendered conductive and the charge capacitor discharges through the tester ignition coil to effect firing of the tester spark gap, thereby testing operation of the CD power pack. The plurality of switches are operative to allow selectively testing different CD power packs adapted for operation with two, three, four and six cylinder engines.

11 Claims, 9 Drawing Figures

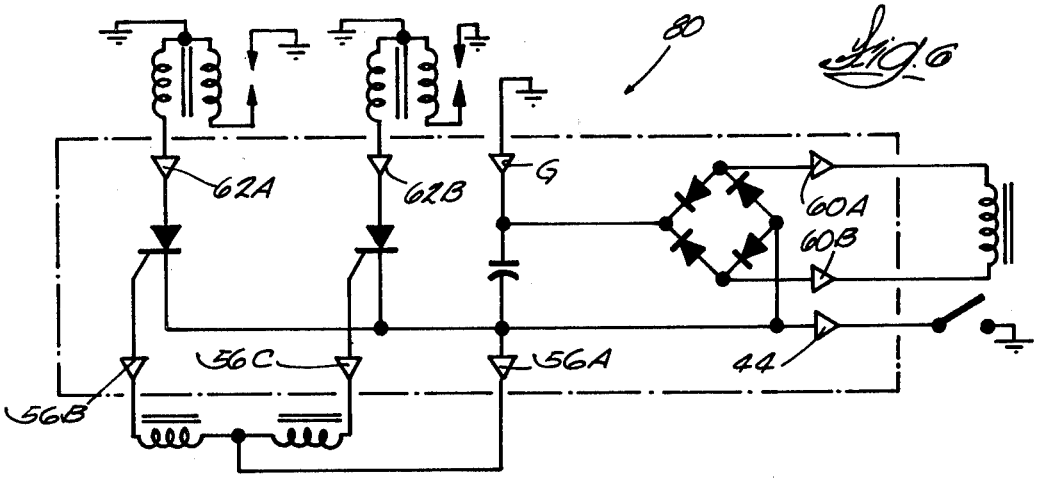
Fig. 6
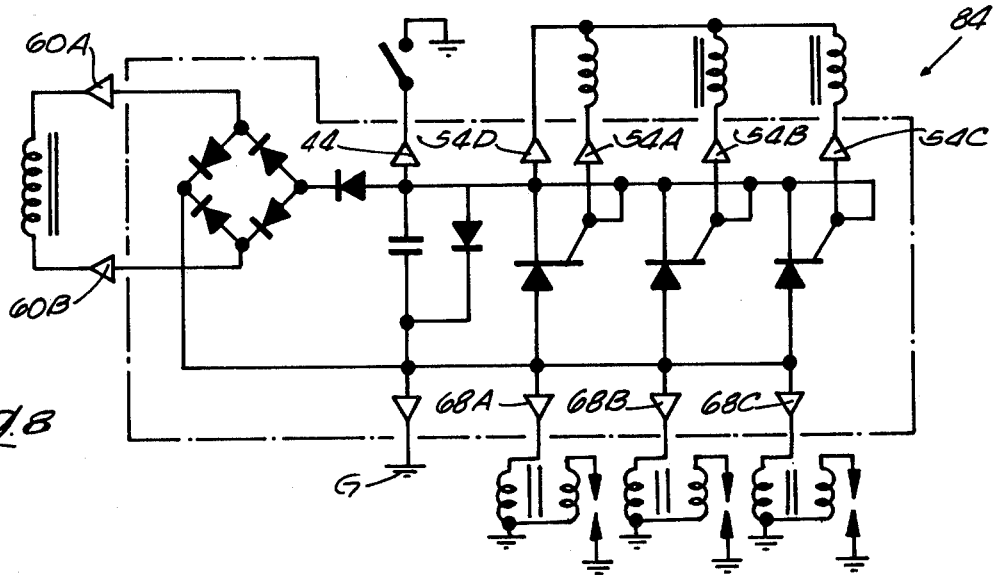
Fig. 8
Fig. 9
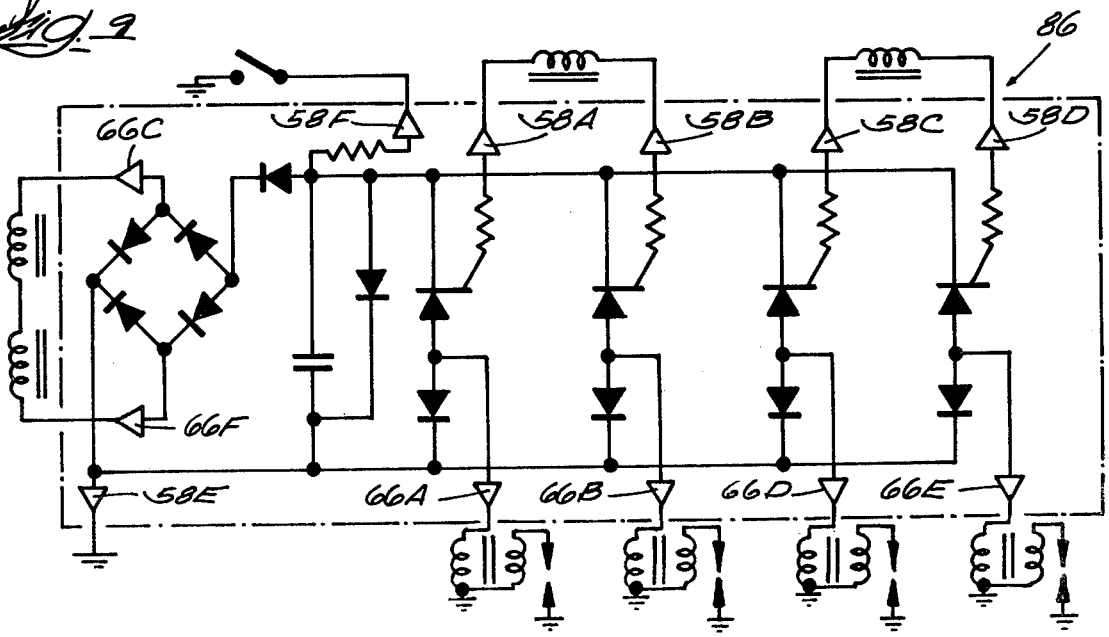

CD POWER PACK TESTER

BACKGROUND OF THE INVENTION

The invention relates generally to ignition testing apparatus, and more particularly, to an ignition testing apparatus for testing CD power pack ignition system components when not mounted on an engine.

Attention is directed to the following U.S. patents:

| | | |
|---|---|---|
| Hartzell | 1,873,121 | August 23, 1932 |
| Powasnick | 2,548,056 | April 10, 1951 |
| Henry | 3,411,071 | November 12, 1968 |
| Zdral | 3,521,155 | July 21, 1970 |
| Widmer | 3,551,800 | December 29, 1970 |
| Miller | 3,784,901 | January 8, 1974 |
| Harris | 3,891,917 | June 24, 1975 |
| Morales | 4,064,450 | December 20, 1977 |
| Doss | 4,101,822 | July 18, 1978 |
| Volk | 4,186,337 | January 29, 1980 |

Attention is also directed to pages 115 through 119 of the April, 1980 issue of POPULAR SCIENCE, and to West German Pat. No. 2425428 issued in December, 1975.

SUMMARY OF THE INVENTION

The invention provides a CD power pack tester adapted for connection to an AC line and to a CD power pack, the CD power pack including a rectifier circuit connected to a charge capacitor normally charged by an engine charge coil, and an ignition SCR which, upon application of a trigger voltage, is rendered conductive and allows the charge capacitor to discharge through an engine ignition coil to effect firing of an engine spark gap. The CD power pack tester comprises a power transformer including a primary winding, and a secondary charging winding having an output for simulating the voltage of an engine charge coil to charge the charge capacitor, trigger means for providing a trigger voltage to the ignition SCR, a tester ignition coil, and a tester spark gap connected to the tester ignition coil. The CD power pack tester also includes switch connection means connected in circuit with the power transformer, the trigger means, and the tester ignition coil, and operative for connecting the primary winding to the AC line and the secondary charging winding to the rectifier circuit to charge the charge capacitor, and for connecting the trigger means to the ignition SCR so that the ignition SCR is rendered conductive and the charge capacitor discharges through the tester ignition coil to effect firing of the tester spark gap, thereby testing operation of the CD power pack.

In accordance with an embodiment of the invention, the trigger means comprises the power transformer also including a secondary trigger winding for providing the trigger voltage to the ignition SCR. The secondary trigger winding preferably includes a center tap for providing a reduced trigger voltage to the ignition SCR.

Also in accordance with an embodiment of the invention, the CD power pack tester further comprises a diode connected in series with the secondary trigger winding to half-wave rectify the trigger voltage, and the switch connection means comprises trigger voltage switch means for selectively applying one of the half-wave rectified trigger voltage and the reduced trigger voltage to the ignition SCR.

Also in accordance with an embodiment of the invention, the switch connection means further comprises recitfier switch means selectively operable for half-wave rectifying the secondary charging winding output.

Also in accordance with an embodiment of the invention the CD power pack tester further comprises an external spark gap, and the switch connection means further comprises bypass switch means for allowing an external ignition coil to be substituted in circuit for the tester ignition coil and to be connected to the external spark gap to allow testing of the external ignition coil. The switch connection means also preferably comprises a grounding switch adapted to be connected to the ignition disabling or grounding switch circuitiry in the CD power pack and to be operative for testing the operation of such grounding switch circuitry.

Also in accordance with an embodiment of the invention, the switch connection means comprises circuit network means for allowing selective testing of a plurality of different CD power packs. The circuit network means is preferably operative for allowing selective testing of a plurality of different power packs including CD power packs adapted for operation with two cylinder, three cylinder, four cylinder and six cylinder engines.

Also in accordance with an embodiment of the invention, the switch connection means comprises a pair of two-pole double-throw switches and a pair of three-pole double-throw switches, with selective operation of one of the switches in a first position testing one ignition SCR in a CD power pack, and selective operation of such one of the switches in a second position testing another ignition SCR in the CD power pack.

One of the principal features of the invention is the provision of a CD power pack tester which can be connected to an AC line and used to test a CD power pack without the need for a whole engine with components, to fire or test the CD power pack.

Another of the principal features of the invention is the provision of such a CD power pack tester which includes a power transformer with a secondary charging winding having an output for simulating the voltage of an engine charge coil, and with a secondary trigger winding for providing a trigger voltage to an ignition SCR of the CD power pack.

Another of the principal features of the invention is the provision of such a CD power pack tester which includes switches to allow a plurality of different CD power packs to be tested, including power packs for two, three, four and six cylinder engines.

Another of the principal features of the invention is the provisions of such a CD power pack tester which includes an external spark gap and a bypass switch which allows the testing of an external ignition coil.

Other features and advantages of the embodiments of the invention will become known by reference to the following general description, the appended claims, and drawings.

DRAWINGS

FIGS. 5 through 9 are also schematic views, each of a different CD power pack which can be connected to the tester shown in FIGS. 1 through 3.

Figure 7:
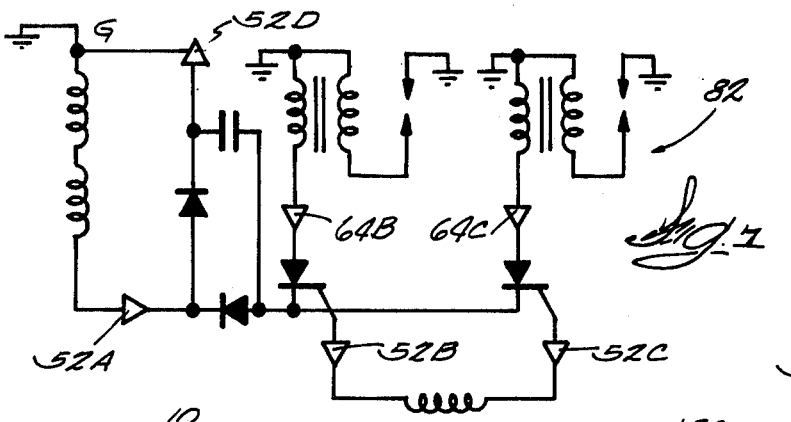

Before explaining the embodiments of the invention in detail, it is to be understood that the invention is not limited in its application to the details of the construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 4:
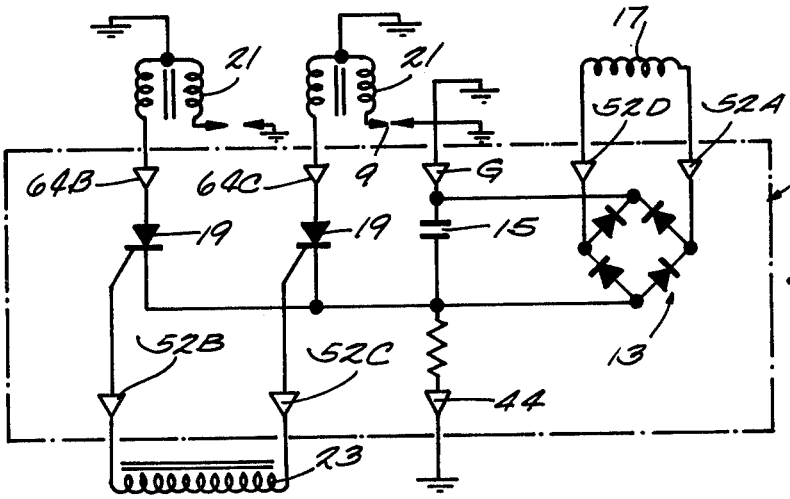
FIG. 4 is a schematic view of a capacitor discharge power pack for an ignition system which can be connected to the tester shown in FIGS. 1 through 3.

Shown in the drawings, wherein like numerals refer to like parts throughout the several views, is a CD ignition test apparatus, more particularly referred to herein as a CD power pack tester, generally designated 10, which embodies various of the features of the invention. The tester 10 can be utilized to test the operation of various conventional CD power packs utilized with other components of an engine ignition system. An example of a CD power pack 11 which can be tested with the tester 10 is shown in FIG. 4. As will be appreciated by those skilled in the art, such a CD power pack (which is partially shown and does not constitute part of the invention disclosed herein) conventionally includes a rectifier circuit 13 connected to a charge capacitor 15 normally charged by an engine charge coil 17, and includes an ignition SCR 19, which upon application of a trigger voltage, is rendered conductive and allows the charge capacitor to discharge through an engine ignition coil 21 to effect firing of an engine spark gap 9. The CD power pack 11 shown in FIG. 4 is designed for use with a two cylinder engine and includes two ignition SCRs 19, each coupled to an ignition coil 21. The components of the CD power pack are typically connected to external engine ignition components (shown outside the dashed line box) including the charge coil 17, the ignition coils 21, and a trigger coil 23, conventionally connected to the gates of the ignition SCR 19.

Returning to a description of the CD power pack tester 10, the tester 10 preferably includes a power transformer 12 which, for example, can be connected to a 110 volt AC line and includes a primary winding 14 and a secondary charging winding 16 having an output for simulating the voltage of an engine charge coil to charge a charge capacitor of a CD power pack. The tester 10 also includes means for providing a trigger voltage to the ignition SCRs of a CD power pack. While various arrangements are possible, as shown in the preferred embodiment, the trigger means comprises the power transformer 12 including a secondary trigger winding 18, preferably having a center tap output 22, to provide a reduced magnitude trigger voltage, and which may be connected to an ignition SCR as will be described below. The tester 10 also includes a tester ignition coil 24 and an internal tester spark gap 26 connected to the ignition coil 24 as shown. The ignition coil 24 and spark gap 26 are contained within a tester case 28, as shown in FIG. 1.

The CD power pack tester 10 also includes switch connection means, generally designated 30, which is connected in circuit with the power transformer 12 and the tester ignition coil 24 as shown. As will be further described below, the switch connection means 30 is operative for connecting the primary winding 14 to an AC line 34, and the secondary charging winding 16 to a rectifier circuit of a CD power pack to charge the charge capacitor. The switch connection means 30 also connects the secondary trigger winding 18 or center tap output 22 to an ignition SCR so that the SCR is rendered conductive and the charge capacitor discharges through the tester ignition coil 24, firing the CD power pack and the tester spark gap 26, thereby testing operation of the CD power pack.

Figure 3:
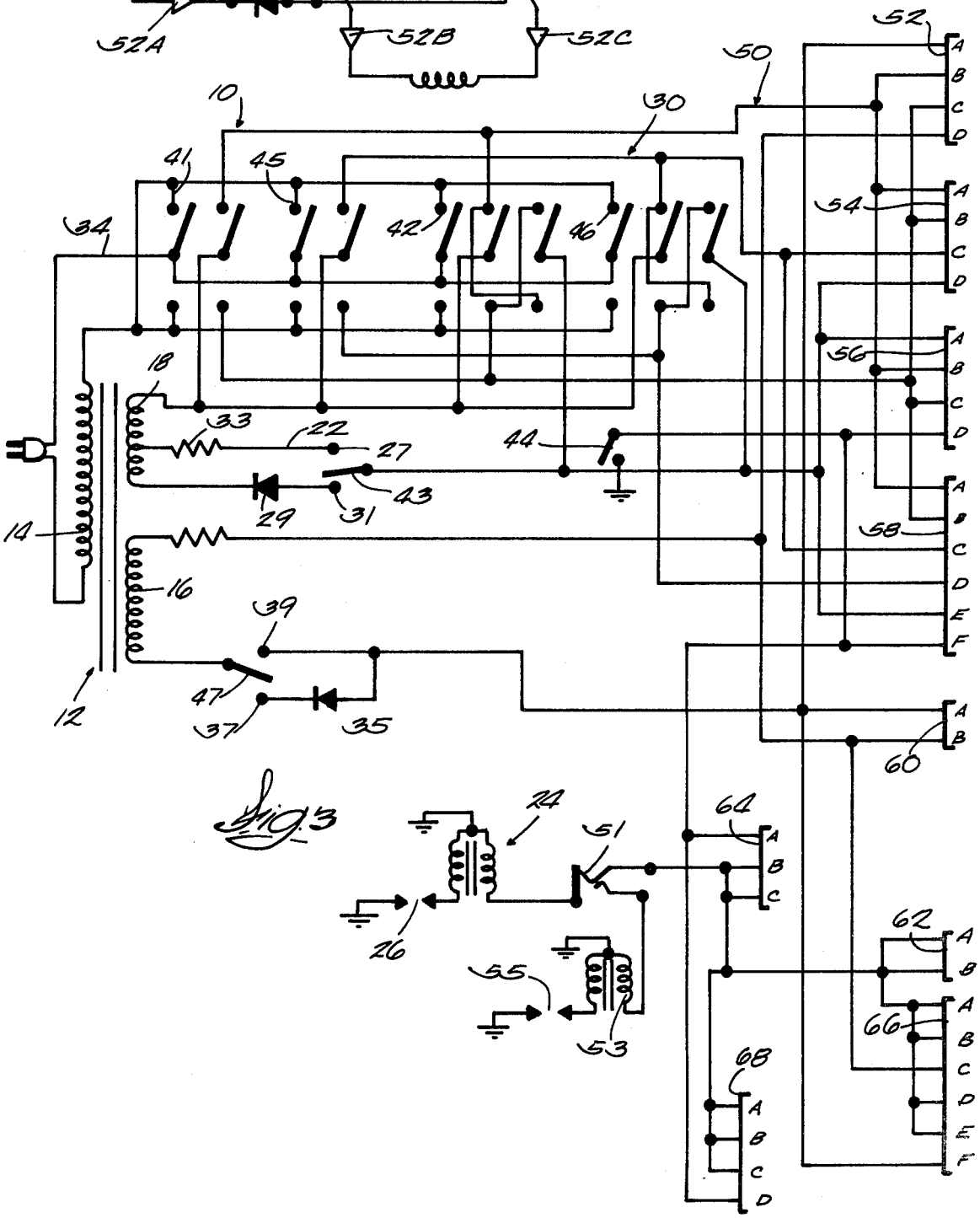
FIG. 3 is a schematic circuit of the CD ignition tester shown in FIGS. 1 and 2 and which embodies various of the features of the invention.
Figure 1:
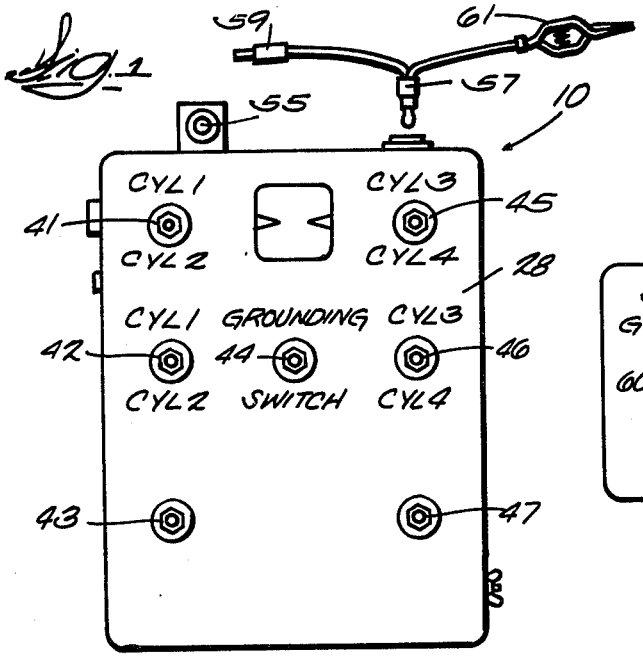
FIG. 1 is a diagrammatic view of a CD power pack tester which embodies various of the features of the invention.

While various switch connection means arrangements are possible, in the preferred embodiment shown, such means comprises a two-pole double-throw switch 41, a three-pole double-throw switch 42, a one-pole double-throw switch 43, a single-pole, single-throw grounding switch 44, another two-pole double-throw switch 45, and another three-pole double-throw switch 46, along with a single-pole double-throw switch 47, as illustrated in FIG. 3 and as corresponds to the correspondingly labelled toggle switches on the tester case 28 illustrated in FIG. 1. Referring to FIG. 3, the lower lead of the secondary trigger winding 18 includes a contact 31 and a diode 29 for insuring unidirectional current flow through the trigger winding 18 when trigger voltage switch means, which preferably comprises the one-pole double-throw switch 43, is moved to make contact with contact 31. When switch 43 makes contact with contact 27 of the center tap 22, a reduced magnitude trigger voltage will be applied to the ignition SCR of the CD power pack, as will be further described below.

For purposes of example only, the primary winding 14 can comprise a 115 volt primary, the secondary charging winding 16 can comprise a 300 volt secondary, and the secondary trigger winding 18 can comprise a 6.3 volt winding with the center tap 22 which preferably includes a current limiting resistor 33, as shown.

Again referring to FIG. 3, the single-pole double-throw switch 47 connected to the lower lead of the secondary charging winding 16 comprises rectifier switch means which is selectively operable in connection with a diode 35 for half-wave rectifying the secondary charging winding output when the switch 47 makes connection with contact 37. When the switch 47 is in the alternate position touching contact 39, the output of the secondary charging winding 16 simulates the output of an engine charge coil. The single-pole single-throw switch 44 comprises a grounding switch adapted to be connected to the point in a CD power pack where the power pack ground switch is connected, and such switch 44 is operative for testing operation of the ground switch circuitry in the CD power pack. Switches 43 and 47 may be moved in one of two positions, while the remaining switches of the switch connection means 30 are preferably momentary switches, ie., conventional switches which return to an open position unless held in a make contact position.

Figure 2:
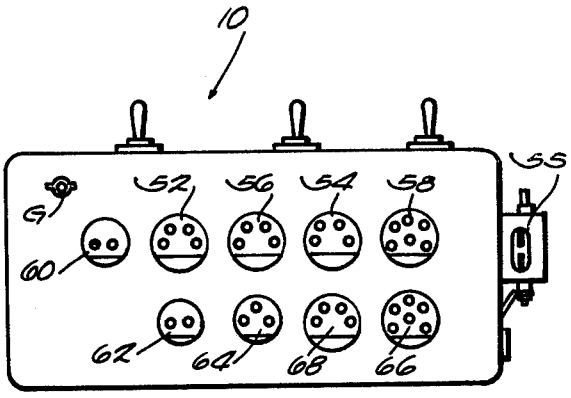
FIG. 2 is a diagrammatic side view of the tester shown in FIG. 1, taken along lines 2—2.

The switch connection means 30 preferably further comprises bypass switch means, shown in the form of a phono jack 51 for allowing an external ignition coil 53 (not a part of the tester 10) to be substituted in circuit for the tester ignition coil 24, and to be connected to an external spark gap 55 mounted on the tester case 28, as shown in FIGS. 1 and 2, to allow testing of any external ignition coil, such as the external ignition coil 53 shown. To assist in such testing, the tester 10 includes a phono plug 57, which includes a connector 59 which is adapted to receive the external ignition coil primary, and another connector or alligator clip 61 which can be connected to the ignition coil ground lead. The high tension lead (not shown) of the external ignition coil is to be connected to the external spark gap 55 mounted on the case of the CD tester 10.

The tester switch connection means 30 also includes circuit network means, generally designated 50, which connects the various switches in circuit and which includes connectors or plugs labelled 52, 54, 56, 58, 60, 62, 64, 66 and 68 as illustrated in FIG. 3 and as corresponds to correspondingly labelled plug connections installed in a side of the tester case 28 as shown in FIG. 2. Each individual lead or connection of each plug is labelled with an upper case letter A, B, C, D, etc. For example, the leads of plug 52 are labelled 52A, 52B, 52C, 52D as shown.

Further description of the components and operation of the CD power pack tester 10 will be given in connection with a description of testing the operation of the CD power packs shown in FIGS. 4 through 9.

In order to test operation of the CD power pack 11 shown in FIG. 4, connections to the power pack circuit are made at points for external connections, diagramatically indicated by open triangles, the triangles being labelled to correspond to the corresponding labelled plugs and leads where connection is made to the CD power pack tester 10. For example, triangles or points labelled 52A and 52D are connected to leads 52A and 52D of the power pack tester 10, which can be operated to selectively connect these points (and the rectifier circuit 13) to the secondary charging winding 16 which stimulates an engine charge coil, and thus charges charge capacitor 15. Points labelled 52B and 52C similarly are connected to corresponding leads 52B and 52C of plug 52, and will be selectively connected to the secondary trigger winding 18 to selectively apply a trigger voltage to ignition SCRs 19. Points labelled 64B and 64C are connected to leads 64B and 64C of plug 64 so that when the charge capacitor 15 is charged and one of the SCRs has a trigger voltage applied to its gate, the CD power pack fires and charge capacitor 15 discharges through the tester ignition coil 24 to fire the spark gap 26. The point in the CD power pack labelled G, which allows for an external ground connection, is connected to the connector or terminal which is a ground for the CD power pack tester, and is correspondingly labelled G, as shown in FIG. 2. More particularly, after the external connection points 52A, 52B, etc. of the CD power pack are connected to the correspondingly labelled leads of tester 10, the following procedure is utilized to test operation of the CD power pack 11.

Single-pole single-throw switch 43 is moved into connection with contact 31 to provide a unidirectional trigger voltage. Single-pole single-throw switch 47 is moved into connection with contact 39 to allow a full wave charging voltage to be applied to the rectifier circuit 13 from secondary charging winding 16. Referring to FIG. 1, momentary toggle switch 42 is moved toward "cylinder 1" which corresponds to the three-pole double-throw switch 42 connecting its center terminals with its upper terminals, as oriented in FIG. 3. Again as oriented in FIG. 3, connection of the left center and left upper terminals results in closing the primary winding circuit so that, assuming connection to an AC socket, the primary winding and secondary trigger and charging windings are energized. When plug 52 is connected to the CD power pack 11, leads 52A and 52D are connected across the secondary charging winding 16. Again, as oriented in FIG. 3, moving of toggle switch 42 toward "cylinder 1" results in connection of the middle and right center terminals with the corresponding upper terminals, so that leads 52B and 52C are coupled across the secondary trigger winding 18, with lead 52B being connected so that positive trigger pulses are applied, thereby providing a trigger voltage to fire the ignition SCR 19 having a gate connected to point 52B, as shown in FIG. 4. Assuming for purposes of example, that the power transformer 14 is plugged into a 110 AC socket, the test is made at approximately 3600 RPM., simulated, and firing occurs across the 25 kilovolt spark gap 26. When toggle switch 42 is momentarily moved towards cylinder 1, assuming proper operation of the CD power pack 11, an ignition spark will appear across the spark gap 26 of the tester. With the power pack firing across gap 26, grounding switch 44 is closed so that the power pack should stop firing, thereby indicating that the ground switch circuitry of the CD power pack is working.

In order to test the other ignition SCR 19 included in the power pack 11, toggle switch 42 is moved toward "cylinder 2" so that the center terminals connect with the lower terminals of switch 42, thereby causing the positive trigger signal to be applied to lead 52C so that the corresponding ignition SCR 19 is rendered conductive. Again, the CD power pack is operating properly if the CD power pack fires and an ignition spark appears across spark gap 26.

Figure 5:
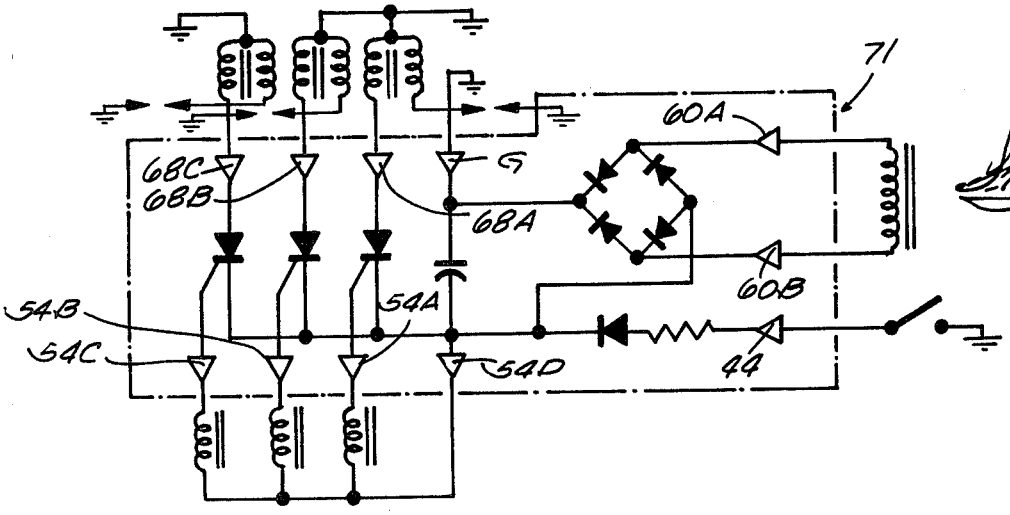

Shown in FIG. 5 is another CD power pack 71 with the major conventional components shown, including a rectifier circuit, a charge capacitor and three ignition SCRs which operate in connection with a external charge coil, three external trigger coils and three external ignition coils as shown. The CD power pack components are not separately labelled since they are conventional and do not constitute part of the invention. In order to demonstrate how the CD power pack tester 10 would be utilized to test the CD power pack 71 shown in FIG. 5, the points for external connection in the CD power pack are again shown as open triangles and labelled to correspond to the correspondingly labelled leads of plugs 54, 60 and 68 of the tester 10. In particular, points 54A, B, C, and D are coupled to corresponding leads of plug 54, points 68A, B, and C are coupled to corresponding leads of plug 68 and points 60A and B, are coupled to corresponding leads of plug 60. As will be appeciated from the prior description, the connections for plug 54 are provided to allow individual triggering of each of the three ignition SCRs contained in power pack 71 while the connections at plug 68 are provided to allow firing of tester spark gap through each of the ignition SCRs. The connection to the plug 60 provides connection of the secondary charging winding 16 to points 60A and 60B in lieu of an engine charge coil.

Operation of the CD power pack 71 is tested as follows. Assuming the connections described above and the ground lead labeled G connected to the point labelled G on tester 10, switch 47 is moved to be in connection with contact 39, switch 43 is moved to be in connection with contact 27 so that the trigger voltage applied is provided from the center tap output 22 through current limiting resistor 33. Referring to FIG. 1, momentary toggle switch 42 is moved towards cylinder 1, which corresponds to three-pole double-throw switch 42 connecting the center terminals with the upper terminals as oriented in FIG. 3, thereby connecting leads 54A and 50D across the center tap output of secondary trigger winding 18, with the result that the CD power pack 71 fires across the spark gap. To test the ignition SCR having its gate connected to 54B, toggle switch 42 is moved towards "cylinder 2" which corresponds to switch 42 connecting the center terminals with the lower terminals, thereby connecting leads 54B and 54D across the trigger coil of the tester 10. To test the third SCR connected to 54C, toggle switch 46 is moved toward "cylinder No. 3" which acuates or corresponds to three-pole double-throw switch 46 connecting the center terminals to the upper terminals so that leads 54C and 54D are connected across the center tap of the trigger coil 18. In each instance, the corresponding anode of the ignition SCR fires through the tester ignition coil 24 by virtue of connection with plug 68. As discussed above, while firing cylinder 1, toggle switch 44 can be closed or moved to the off position and the CD power pack 71 should stop firing, indicating the ground switch circuitry for the CD power pack 71 is working.

In order to test the external ignition coil 53, when a good CD power pack is connected to the tester 10, the external ignition coil primary lead is connected to connector 59 which is attached to the phono plug 57. The ignition coil ground lead should be connected to the aligator clip 61. The high tension lead of the external coil should be connected to the external spark gap 55 on the CD tester 10. The external ignition coil can then be tested by virtue of testing the CD power pack in the manner described above. The external coil 53 is good if a spark appears across the external spark gap 55.

The circuit network means 50 can be utilized for allowing selective testing of a plurality of different power packs including CD power packs for operation with two and three cylinder engines as discussed above and four cylinder and six cylinder engines. The CD power pack for a six cylinder engine, for example, could include two CD power packs such as CD power pack 71, each for three of the six engine cylinders.

Shown in FIGS. 6 through 9 are additional CD power packs which are conventional in nature, and accordingly, only the major components are shown. Points for external connection to the tester 10 are again designation by triangles, labelled to correspond to the correspondingly labelled leads of the plugs of the CD power pack tester 10. In some instances, external wiring harnesses (not shown) may be utilized to facilitate such connections.

Testing of these additional CD power packs is similar to the testing of CD power packs 11 and 71 already described, and thus such testing will be described in a summary fashion. Referring to the CD power pack shown in FIG. 6, generally designated 80, the leads of plugs 56, 60 and 62 are connected from the tester 10 to the CD power pack as shown. Toggle switch 43 is moved into connection with contact 27 and toggle switch 47 is moved into connection with contact 39. In order to test operation of power pack 80, toggle switch 41 is moved upward towards "cylinder 1" thereby testing the ignition SCR connected to point 56B. Toggle switch 41 is moved downward to "cylinder 2" to test the ignition SCR connected to point 56C. With the power pack firing, grounding switch 44 is closed so that the CD power pack 80 should stop firing, indicating a working ground switch circuit.

Referring to the CD power pack 82 shown in FIG. 7, leads of plugs 52 and 64 are connected to connect the tester 10 and CD power pack as shown. Toggle switch 43 is moved in connection with contact 27 and toggle switch 47 is moved into connection with contact 37, to provide a half-wave rectified charging voltage from the secondary charging winding 16.

In order to test operation of power pack 82, the toggle switch 42 is moved towards cylinder 1 to effect testing of the ignition SCR connected to point 52B and toggle Switch 42 is moved towards cylinder 2 to effect testing of the ignition SCR connected to point 52C.

Referring to FIG. 8 and the CD power pack generally labelled 84, which is suitable for 3 cylinder engines, leads of plugs 54, 60 and 68 are connected to connect tester 10 and power pack 84. Toggle switch 43 is moved into connection with contact 27 and toggle switch 47 is moved into connection with contact 39. In order to test operation, toggle switch 41 is moved towards cylinder 1 to fire the power pack ignition SCR coupled to point 54A, toggle switch 41 is moved towards cylinder 2 to fire the ignition SCR coupled to point 54B, and toggle switch 45 is moved towards cylinder 3 to fire the ignition SCR coupled to point 54C.

Referring to CD power pack 86 in FIG. 9, which is suitable for use with a four cylinder engine, leads of plugs 58 and 66 are connected to connect the tester 10 and power pack as shown. Toggle switch 43 is moved in connection with contact 27 and toggle switch 42 is moved towards cylinder 1 to fire the ignition SCR having a gate coupled to point 58A. Toggle switch 42 is moved towards cylinder 2 to fire the ignition SCR having a gate coupled to point 58B. Toggle switch 46 is moved toward cylinder 3 to fire the ignition SCR having a gate coupled to point 58C, and toggle switch 46 is moved towards cylinder 4 to fire the ignition SCR having a gate connected to point 58D.

It is to be understood that the invention is not confined to the particular construction and arrangement of parts herein illustrated and described, but embraces all such modified forms thereof as come within the scope of the following claims.

I claim:

1. A CD power pack tester adapted for connection to an AC line and to a CD power pack, the CD power pack including a rectifier circuit connected to a charge capacitor normally charged by an engine charge coil, and an ignition SCR which, upon application of a trigger voltage, is rendered conductive and allows the charge capacitor to discharge through an engine ignition coil to effect firing of an engine spark gap, said tester comprising a power transformer including a primary winding, and a secondary winding having an output for simulating the voltage of an engine charge coil to charge the charge capacitor, trigger means for providing a trigger voltage to the ignition SCR, a tester ignition coil, a tester spark gap connected to said tester ignition coil, and switch connection means connected in circuit with said power transformer, said trigger means, and said tester ignition coil, and operative for connecting said primary winding to the AC line and said secondary charging winding to the recitifier circuit to charge the charge capacitor, and for connecting said trigger means to the ignition SCR so that the ignition SCR is rendered conductive and the charge capacitor discharges through said tester ignition coil to effect firing of said tester spark gap, thereby testing operation of the CD power pack.

2. A CD power pack tester in accordance with claim 1, wherein said trigger means comprises said power transformer also including a secondary trigger winding for providing said trigger voltage to the ignition SCR, and wherein said secondary trigger winding includes a center tap for providing a reduced trigger voltage to the ignition SCR.

3. A CD power pack tester in accordance with claim 2, further comprising a diode connected in series with said secondary trigger winding to half-wave recitify said trigger voltage and wherein said switch connection means comprises trigger voltage switch means for selectively applying one of said half-wave rectified trigger voltage and said reduced trigger voltage to the ignition SCR.

4. A CD power pack tester in accordance with claim 1, wherein said switch connection means further comprises rectifier switch means selectively operable for half-wave rectifying the secondary charging winding output.

5. A CD power pack tester in accordance with claim 1, further comprising an external spark gap, and wherein said switch connection means further comprises bypass switch means for allowing an external ignition coil to be substituted in circuit for said tester ignition coil and to be connected to said external spark gap to allow testing of the external ignition coil.

6. A CD power pack tester in accordance with claim 1 wherein the CD power pack includes ground switch circuitry and wherein said switch connection means further comprises a grounding switch adapted to be connected to ground switch circuitry in the CD power pack ground to be operative for testing the operation of the ground switch circuitry.

7. A CD power pack tester in accordance with claim 1, wherein said switch connection means comprises circuit network means for allowing selective testing of a plurality of different CD power packs.

8. A CD power pack tester in accordance with claim 7 wherein said circuit network means is operative for allowing selective testing of a plurality of different CD power packs including CD power packs operative with two cylinder, three cylinder, and four cylinder engines.

9. A CD power pack tester in accordance with claim 8 wherein the CD power pack includes two ignition SCRs, and wherein said switch connection means comprises a pair of two-pole double-throw switches and a pair of three-pole double-throw switches, with selective operation of one of said switches in a first position testing one ignition SCR in a CD power pack, and selective operation of said one of said switches in a second position testing the other ignition SCR in the CD power pack, testing of each ignition SCR occurring by charge capacitor discharge through said tester ignition coil to effect firing of said tester spark gap.

10. A CD power pack tester adapted for connection to an AC line and to a CD power pack, the CD power pack including a rectifier circuit connected to a charge capacitor normally charged by an engine charge coil, and an ignition SCR which, upon application of a trigger voltage, is rendered conductive and allows the charge capacitor to discharge through an engine ignition coil to effect firing of an engine spark gap, said tester comprising a power transformer including a primary winding, and a secondary winding having an output for simulating the voltage of an engine charge coil to charge the charge capacitor, trigger means for providing a trigger voltage to the ignition SCR, a tester ignition coil, a tester spark gap connected to said tester ignition coil, and switch connection means connected in circuit with said power transformer, said trigger means, and said tester ignition coil, and operative for connecting said primary winding to the AC line and said secondary charging winding to the recitifier circuit to charge the charge capacitor, and for connecting said trigger means to the ignition SCR so that the ignition SCR is rendered conductive and the charge capacitor discharges through said tester ignition coil to effect firing of said tester spark gap, thereby testing operation of the CD power pack, said tester further comprising an external spark gap, and said switch connection means further comprising bypass switch means for allowing an external ignition coil to be substituted in circuit for said tester ignition coil and to be connected to said external spark gap to allow testing of the external ignition coil.

11. A CD power pack tester adapted for connection to an AC line and to a CD power pack, the CD power pack including a rectifier circuit connected to a charge capacitor normally charged by an engine charge coil, and an ignition SCR which, upon application of a trigger voltage, is rendered conductive and allows the charge capacitor to discharge through an engine ignition coil to effect firing of an engine spark gap, said tester comprising a power transformer including a primary winding, anda secondary winding having an output for simulating the voltage of an engine charge coil to charge the charge capacitor, trigger means for providing a trigger voltage to the ignition SCR, a single tester ignition coil, a single tester spark gap connected to said tester ignition coil, and switch connection means connected in circuit with said power transformer, said trigger means, and said tester ignition coil, and operative for connecting said primary winding to the AC line and said secondary charging winding to the recitifier circuit to charge the charge capacitor, and for connecting said trigger means to the ignition SCR so that the ignition SCR is rendered conductive and the charge capacitor discharges through said tester ignition coil to effect firing of said tester spark gap, thereby testing operation of the CD power pack, said switch connection means comprising circuit network means operative for allowing selective testing of a plurality of different CD power packs including CD power packs operative with two cylinder, three cylinder, and four cylinder engines, each of such CD power packs including a separate ignition SCR corresponding to an engine cylinder, each of said separate ignition SCR'c being tested by charge capacitor discharge through said single tester ignition coil to effect firing of said single tester spark gap.

* * * * *

UNITED STATES PATENT AND TRADEMARK OFFICE

CERTIFICATE OF CORRECTION

PATENT NO. : 4,463,315

DATED : July 31, 1984

INVENTOR(S) : John M. Kutzler

It is certified that error appears in the above-identified patent and that said Letters Patent is hereby corrected as shown below:

Column 10, line 37, "anda" should be --and a --.

Column 10, line 59, "SCR'c" should be --SCR's--.

Signed and Sealed this

*Twenty-third* Day of *July 1985*

[SEAL]

*Attest:*

DONALD J. QUIGG

*Attesting Officer* *Acting Commissioner of Patents and Trademarks*